United States Patent [19]

Rebhan

[11] Patent Number: 4,615,451

[45] Date of Patent: Oct. 7, 1986

[54] SUSPENSION DEVICE FOR A CONTAINER HAVING A CAP

[75] Inventor: Horst Rebhan, Stockheim-Wolfersdorf, Fed. Rep. of Germany

[73] Assignee: Frankenwald-Presserei Horst Rebhan, Stockheim, Fed. Rep. of Germany

[21] Appl. No.: 731,840

[22] Filed: May 8, 1985

[30] Foreign Application Priority Data

May 10, 1984 [DE] Fed. Rep. of Germany ... 8414322[U]

[51] Int. Cl.[4] ..... B65D 51/24

[52] U.S. Cl. ..... 215/100 A

[58] Field of Search ..... 215/100 A, 100 R; 220/94 R, 94 A

[56] References Cited

U.S. PATENT DOCUMENTS

| | | | |
|---|---|---|---|
| 2,627,996 | 2/1953 | Dorner | 220/94 R X |
| 2,882,388 | 4/1959 | Garland | 220/94 A UX |
| 3,401,827 | 9/1968 | Messina | 220/94 A |
| 3,462,035 | 8/1969 | Grussen | 220/94 A X |

FOREIGN PATENT DOCUMENTS

| | | | |
|---|---|---|---|
| 1404567 | 5/1965 | France | 215/100 A |

*Primary Examiner*—Donald F. Norton

[57] ABSTRACT

A suspension loop of synthetic material or the like is attached with its ends to the cap which is provided with a groove into which the groove is releasably insertable for compactness during packaging, transport or sale. The loop can then be lifted from the groove to perform its suspension function. Where the cap is provided with a closing flap, this may also have groove for receiving the suspension loop.

2 Claims, 3 Drawing Figures

SUSPENSION DEVICE FOR A CONTAINER HAVING A CAP

Figure 1:
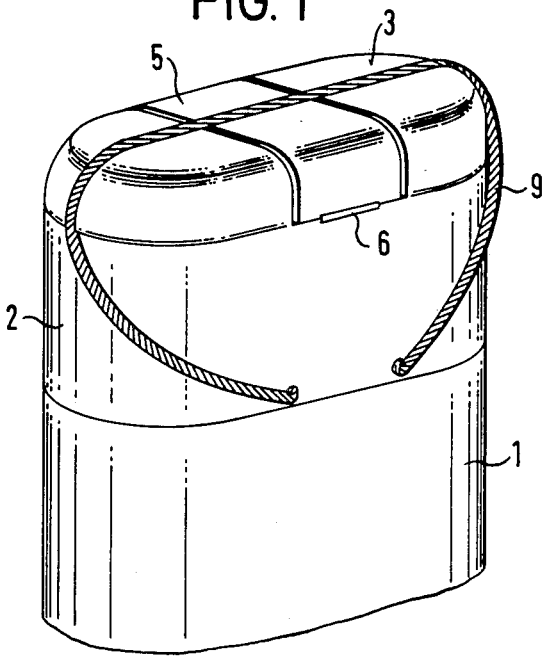

The present invention relates to suspension devices for containers provided with a cap such as bottles, tins, tubes and the like of glass, synthetic material or metal and having a suspension loop formed from a cord or the like.

Suspension devices of this type have been known for a long time in various embodiments. The suspension loop normally consists in this connection of an injection moulded part of flexible synthetic material which is in the form of a cord, a string, a band or the like.

Various constructions are known for securing of the suspension and loop. In one of these constructions the suspension loop is provided in the region of its ends with a push button like extension which can be snapped into a correspondingly formed recess on the rear side of the container. Such constructions are however very expensive since the suspension loop must be manufactured as a separate part, the recess on the rear side of the container makes the form of the container more complicated for manufacture and an additional processing step is necessary for assembly of the suspension loop and the container. It is however of particular disadvantage that the suspension loop stands away from the container after assembly which is then obstructive during the packing process during shipment and during sale.

It is true that also less expensive constructions are known in which the suspension loop formed in the shape of a ring is constructed in one piece with the cap so that the above described assembly and thus the necessary additional processing steps are omitted. However even in these constructions the suspension loop stands away from the cap whereby problems occur in feeding to the closure machine, in screwing of the closure onto the container, in packing, in despatch and during sale.

An object of the present invention is to provide a completely new suspension device in which the problems associated with protrusion of the suspension loop from the container or from the cap do not appear.

This object is solved according to the invention in that the suspension loop is at least partially releasably sunk in a groove formed in the cap and is secured with its ends on the cap in a manner known per se.

By means of the features according to the invention, for the first time a suspension device is provided in which the suspension loop is completely integrated into the cap as a result of the arrangement in the groove. There are therefore no protruding sections which can be obstructive in feeding to closure machines, in screwing the cap onto the container, in packing, during despatch and during sale.

In order to use the suspension loop in application of the container, it is only necessary to lift this from the groove which is possible as a result of the flexible construction by means of a simple handgrip.

Basically, the suspension loop can be secured on the cap with its ends in any desired fashion. It is however advantageous if the suspension loop is formed in one piece with the cap, i.e. is manufactured together with this in one working process. With this manufacturing process, the suspension loop can already be provided with the necessary form for sinking into the groove.

Basically, the groove suspension loop can be guided across the cap in any desired manner. According to the respective purpose of use and appearance, a symmetrical or asymmetrical position of the groove on the cap can be selected. A particularly expedient construction is however achieved if the groove passes across the upper side of the cap.

The suspension devices of the type according to the invention are suitable in particular for caps whose outlet opening for container contents is covered by means of a closure flap. According to a preferred further development of the invention, in such a construction the suspension loop passes across the closure flap in the position sunk into the groove. In such an embodiment, the suspension loop protects the closure flap during despatch and transport so that undesired opening and thus loss of the container contents is prevented. In an addition to its suspension function, the suspension loop thus has a securing function during despatch and transport.

With appropriate construction, the suspension loop can also have an originality function in addition to its security function. Thus, for example by arrangement of a seal mark or the like on the suspension loop it can be made apparent whether the container has already been opened or whether the container is still in its originally closed condition.

Basically, the suspension loop can pass across the closure flap in any desired manner. Particularly secure position or fixing of the suspension loop is however achieved according to a preferred embodiment of the invention if the closure flap is provided with a groove which is aligned with the groove arranged in the cap.

Figure 2:
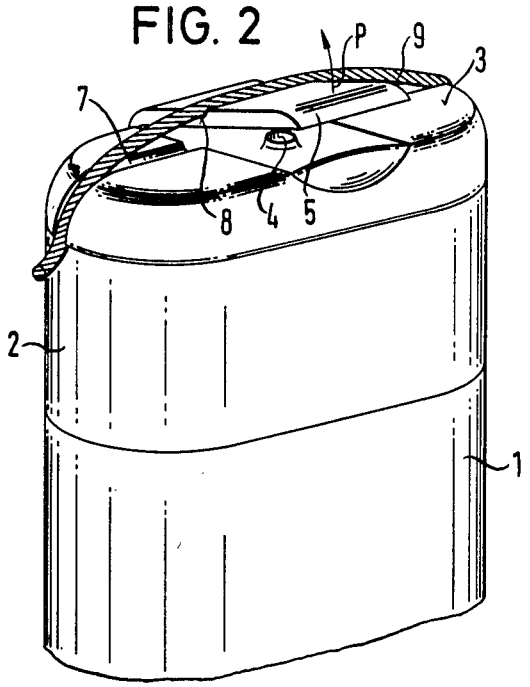
Figure 3:
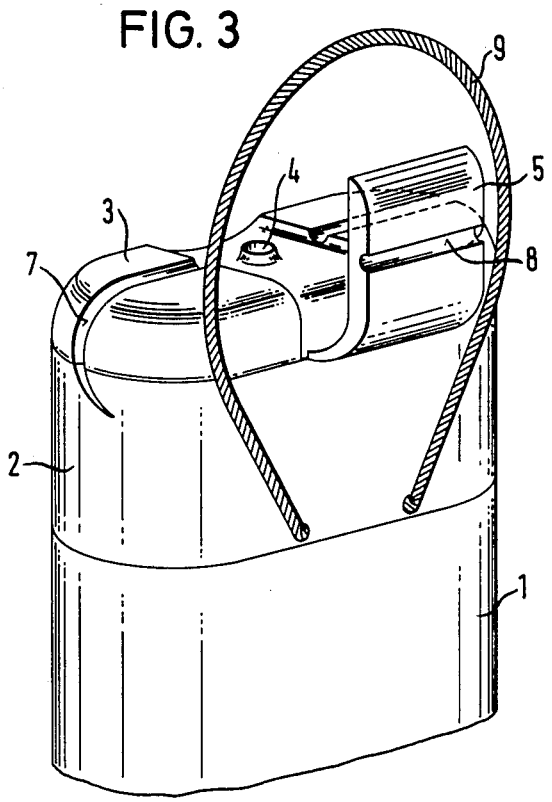

In the following, for further explanation and better understanding an exemplary embodiment of the invention is described in more detail with reference to the accompanying drawings, in which FIG. 1 shows a suspension device according to the invention in which the suspension loop lies in a groove formed in the cap, FIG. 2 shows in a first phase lifting of the suspension loop from the groove during the opening process, and FIG. 3 shows the suspension loop in its operating position when the container is opened.

As appears from the figures, container 1 of synthetic material or the like is provided with a cap 2. The cap 2 has on its upper side 3 an outlet opening 4 for the container contents. This outlet opening 4 can be closed with a closure flap 5 which in a manner known per se is connected to the cap 2 in one piece via a film hinge 6.

In the present exemplary embodiment, a groove 7 passes across the upper side 3 of the cap 2. The closure flap 5 is likewise provide with a groove 8 which is aligned with the groove 7 arranged in the cap 2.

On the cap 2 a suspension loop 9 is moulded on in the region of the lower edge beneath the film hinge 6. This suspension loop 9 is constructed in such manner that it has the structure of a cord, a string or the like. The length of the suspension loop 9 is such that in the position in which it is sunk into the groove 7 and the groove 8 (see FIG. 1) it lies closely against the cap 2. In this manner, problems in feeding to closure machines, in screwing of the cap onto the container in packing, in despatch and during sale are prevented.

When in the position sunk into the groove, the suspension loop as already described above, has a security function. Thus, the closure flap 5 is retained in its closed position by the suspension loop 9 lying in the groove 8, so that undesired opening and thus loss of the container contents is prevented.

With appropriate arrangement of a seal or the like, suspension loop 9 has moreover an originality function such as already been described above.

Containers with suspension devices of the type according to the invention are delivered to the user in a condition as illustrated in FIG. 1. The suspension loop lies in this connection in the groove 7 passing across the upper side of the cap 2 and in its remaining sections lies closely against the outer wall of the cap.

If the container is now opened by the user for the first time, the closure flap 5, as illustrated in FIG. 2, is pushed upwardly in the direction of the arrow P. As a result of this movement of the closure flap 5, the suspension loop 9 is lifted out of the groove 7. As a result of its elasticity, the suspension loop 9 then jumps into the position shown in FIG. 3 in which it remains even following reclosure of the container, i.e. following pivoting of the closure flap 5 back into the closure position.

This means that the suspension loop 9 remains in the position illustrated in FIG. 3 after the first opening of the container in which position it can fulfil the suspension function.

I claim:

1. Suspension device for containers provided with a cap, comprising: a suspension loop and a groove in said cap, said suspension loop being adaptable to being releasably sunk at least partially into said groove and being secured at its ends onto said cap, said cap being provided with a closure flap, and said suspension loop passing across said closure flap when in the position sunk into said groove.

2. Suspension device according to claim 1 wherein the closure flap is provided with a groove which is aligned with the groove provided in the cap, when the flap is closed.

* * * * *